US006227028B1

(12) United States Patent
Jeandeaud

(10) Patent No.: US 6,227,028 B1
(45) Date of Patent: May 8, 2001

(54) DEVICE FOR ADAPTING THE SIZE OF A MACHINE TOOL JAW

(75) Inventor: Jean-Claude Jeandeaud, Saint Marcel Bel Accueil (FR)

(73) Assignee: DUO Forma, Genas (FR)

( * ) Notice: Subject to any disclaimer, the term of this patent is extended or adjusted under 35 U.S.C. 154(b) by 0 days.

(21) Appl. No.: 09/214,487

(22) PCT Filed: Jul. 7, 1997

(86) PCT No.: PCT/FR97/01227

§ 371 Date: Jan. 5, 1999

§ 102(e) Date: Jan. 5, 1999

(87) PCT Pub. No.: WO98/01245

PCT Pub. Date: Jan. 15, 1998

(30) Foreign Application Priority Data

Jul. 5, 1996 (FR) ..... 96 08641

(51) Int. Cl.[7] ..... B21D 5/04
(52) U.S. Cl. ..... 72/323; 72/319
(58) Field of Search ..... 72/319, 323, 413, 72/481.1

(56) References Cited

U.S. PATENT DOCUMENTS

| | | | | |
|---|---|---|---|---|
| 4,532,792 | * | 8/1985 | Hongo | 72/319 |
| 4,656,861 | * | 4/1987 | Koyama | 72/323 |
| 4,722,214 | | 2/1988 | Hayashi et al. | 72/319 |
| 4,765,171 | * | 8/1988 | Klingesberger | 72/319 |
| 5,168,745 | * | 12/1992 | Miyagawa | 72/323 |

FOREIGN PATENT DOCUMENTS

| | | | | |
|---|---|---|---|---|
| 0 332 221 A2 | | 9/1989 | (EP) . | |
| 0 682 996 A2 | | 11/1995 | (EP) . | |
| 0 713 734 | | 5/1996 | (EP) . | |
| 148021 | * | 9/1983 | (JP) | 72/319 |

* cited by examiner

*Primary Examiner*—Daniel C. Crane
(74) *Attorney, Agent, or Firm*—Oliff & Berridge, PLC

(57) ABSTRACT

A device that includes a frame equipped with guiding means, blank holder modules to be moved along the guiding means, means for blocking independently each blank holder module in a specific position, a magazine of end modules located near each end of the guiding means and gripping and handling means for grasping an end module to fix the end module to a blank holder module and vice-versa.

20 Claims, 5 Drawing Sheets

DEVICE FOR ADAPTING THE SIZE OF A MACHINE TOOL JAW

This application is a 371 of PCT/FR97/01227, filed Jul. 7, 1997.

The present invention relates to a device for adapting the size of a jaw.

BACKGROUND OF THE INVENTION

A jaw is a machine tool part designed for machining elements in the form of sheets, such as sheet metal, that holds the machined sheet firmly. Jaws are found, for example, in drawing machines and bending brakes.

The size of the jaw must be adapted to the size of the sheet metal to be machined and to the operation carried out. To be able to machine pieces of sheet metal of different sizes on the same machine tool, it is necessary to be able to change the size of the jaw.

Adapting the entire jaw to the size of the sheet metal to be machined without manual intervention is known.

The main drawback of conventional systems for adapting the size of a jaw automatically is that this operation takes a relatively long time, thus limiting productivity in relation to flexibility. The time required to machine the sheet metal is less than the time taken to adapt the jaw in known systems. Hence, a user will endeavor to fabricate several parts with the same size before changing the size of the jaw.

Moreover, for optimization reasons, manufacturers recommend first running operations requiring a short jaw on the machine tool equipped with a modular jaw, and subsequently, running operations requiring a long jaw. The user, thus, has to adjust the machining sequence to these constraints.

SUMMARY OF THE INVENTION

The goal of the invention is to furnish a device enabling the size of a jaw to be adapted very rapidly to improve the flexibility of a machine tool designed to receive this jaw and enable the various machining operations to be conducted in any sequence without thereby affecting cycle time.

For this purpose, the device it proposes consists of a frame provided with guide means, jaw modules designed to move along the guide means, means for independently locking each jaw module into a given position, a magazine of end modules located near each end of the guide means and gripping and handling means for gripping an end module in a magazine to position the end module against a jaw module and withdraw an end module positioned against a jaw module to replace it in a magazine.

The configuration of the jaw can then be changed very rapidly. One need only move the jaw modules not used for making a predefined bend toward the ends of the guide means and regroup the jaw modules needed for this bending operation at the center of the guide means then, with the aid of gripping means, bring an end module to each end of the group of jaw modules to form a jaw of the desired size for making the bend. All these operations can be conducted rapidly, because the jaw modules can move at the same time as the end modules.

Advantageously, a module, called a central module, is mounted in a fixed position relative to the frame. The movable jaw modules are located on each side of the central module. The jaw modules on a given side of the central module are all similar, and the jaw modules on one side of the central module have a different length in the direction of the guide means than those located on the other side of the central module. The central module then serves as a stop when the jaw modules are being moved. The different lengths of the jaw modules on one side and on the other side of the central module enables a greater variety of different jaw lengths to be offered. If, for example, all the jaw modules and the central module are 100 mm long, the assembly formed by the jaw modules and the central module will always be a multiple of 100 mm long. On the other hand, if the jaw modules on one side are 100 mm long and those on the other side are 50 mm or 150 mm long, it will also be possible to have total lengths that are multiples of 50 mm. Of course, other values and other length ratios are possible.

In a preferred embodiment, the guide means are comprised of at least one rectilinear rail integral with the frame. In this case, advantageously, the jaw modules are mounted on two parallel rails between which is guided a drive bar, and the locking means enable each jaw module, independently of the others, to be coupled to either the drive bar or the guide rails. To move the jaw modules, one need only join them to the drive bar and move the latter with these modules. The other jaw modules that are not supposed to move remain coupled to the frame. To shift all the jaw modules that are to be moved, one need only move the drive bar once in one direction with the modules moving in the same direction, then move the jaw modules that are supposed to move, in the other direction.

In a preferred embodiment, each jaw module has a locking part that can move perpendicularly to the guide rails. The locking part has a U-shaped section perpendicularly to the guide rails with the end of one arm of the U being in a lengthwise groove provided in a rail. The other arm end of the U is opposite the other guide rail and the drive bar projects between these two arms. A spring pretensions the locking part in one direction making the locking part coupled to the frame or the drive bar. An actuator is provided to act against the spring to make the locking part coupled to the drive bar or the frame.

To drive the drive bar, it is provided with a rack meshing with a gear driven by a motor. Other means are of course possible: the bar can, for example, be connected to an actuator or to a linear motor.

In the device according to the invention, the gripping and handling means may be a gripper moving lengthwise on the frame. Other solutions such as a manipulator robot are also possible.

The invention also proposes using a device such as that described above on a machine designed to make bends in a piece of sheet metal, having two jaws and one bending tool. In such a machine, there is no point in having two modular jaws; a single jaw is generally sufficient.

Such a machine, or bending brake, can adapt the size of its jaw during the time taken for the bent piece of metal to leave and the metal to be bent to take its place. For sheets to be bent on two opposite sides, the invention proposes a machining center, characterized by having two bending brakes according to the invention, the two bending brakes being opposite each other and able to move toward or away from each other, and by a conveyor designed to convey the pieces of sheet metal being located between the two bending brakes. The conveyor can also be provided with a central rotator which is placed between the two bending brakes and is able to turn the sheets to be bent on four sides—or more.

In any event, the invention will be properly understood with the aid of the description that follows with reference to the attached schematic drawings that show a device according to the invention as a nonlimiting example.

BRIEF DESCRIPTION OF THE DRAWINGS

Embodiments of this invention will be described in detail, with reference to the following drawings wherein like numerals represent like elements and wherein.

DETAILED DESCRIPTION OF PREFERRED EMBODIMENTS

Figure 1:
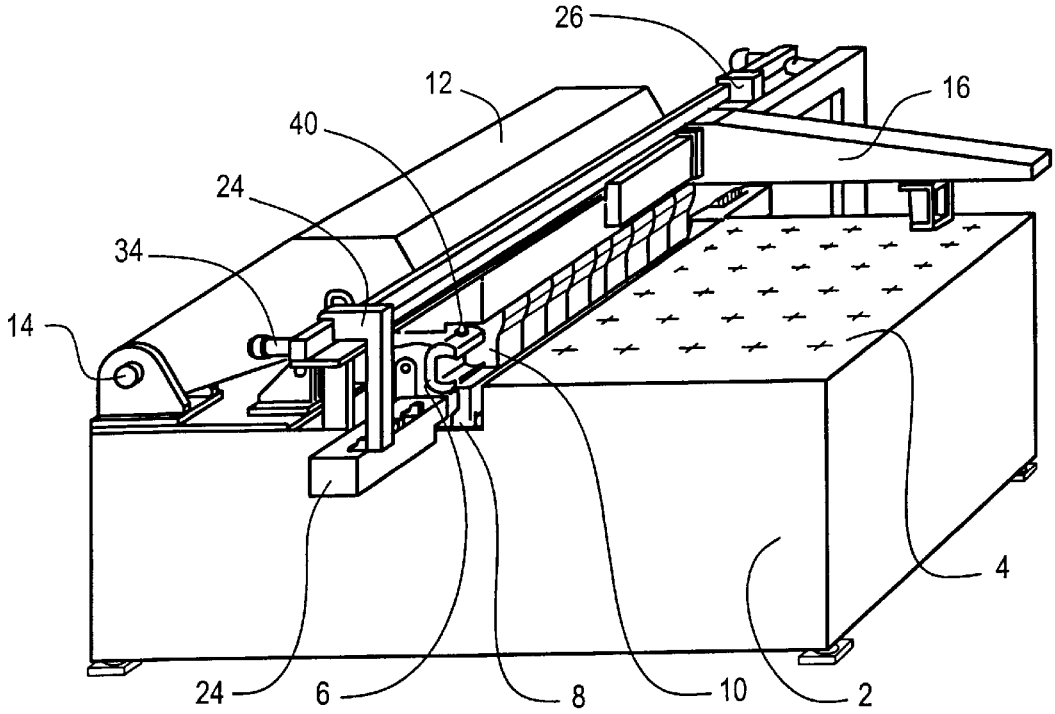
FIG. 1 shows a machine designed to bend pieces of sheet metal, provided with a device according to the invention.

As one application example of a device for adapting the size of a jaw, FIG. 1 shows a sheet metal bending brake provided with such a device.

This bending brake has a bench 2, a brush table 4 designed to receive a sheet of metal (not shown in this figure) to be bent, a bending tool 6, a fixed lower jaw 8, an upper jaw 10 mounted on an arm 12 pivoting around an axis 14, and a manipulator robot 16 to move the sheets to be bent.

The width of upper jaw 10 is modular. Thus, the bending brake can be adapted to numerous sheet dimensions and several types of bending. The means whereby the size of jaw 10 is modified are described below.

Figure 2:
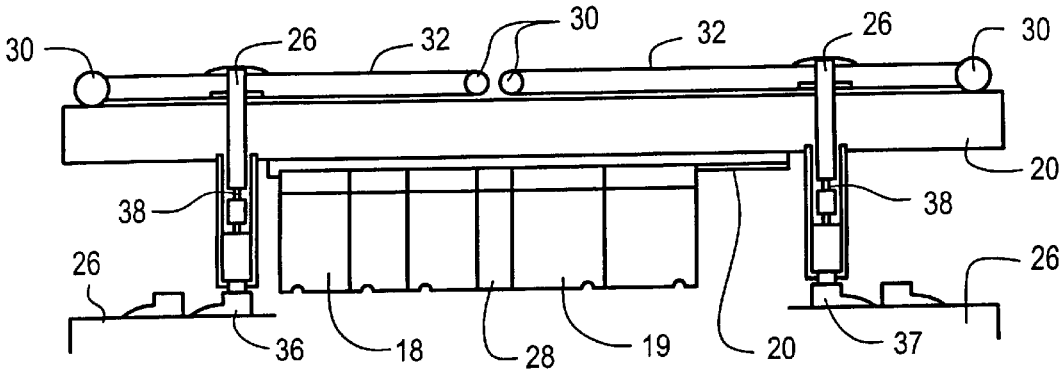
FIGS. 2 and 3 are schematic front views showing the device in two different positions.
Figure 3:
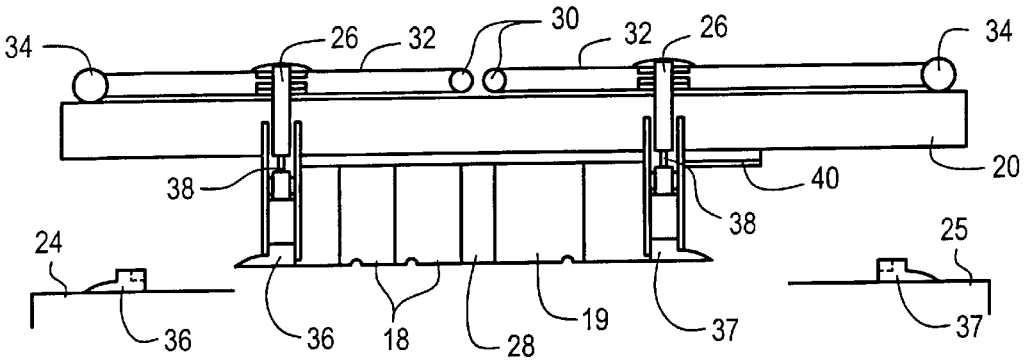
Figure 4:
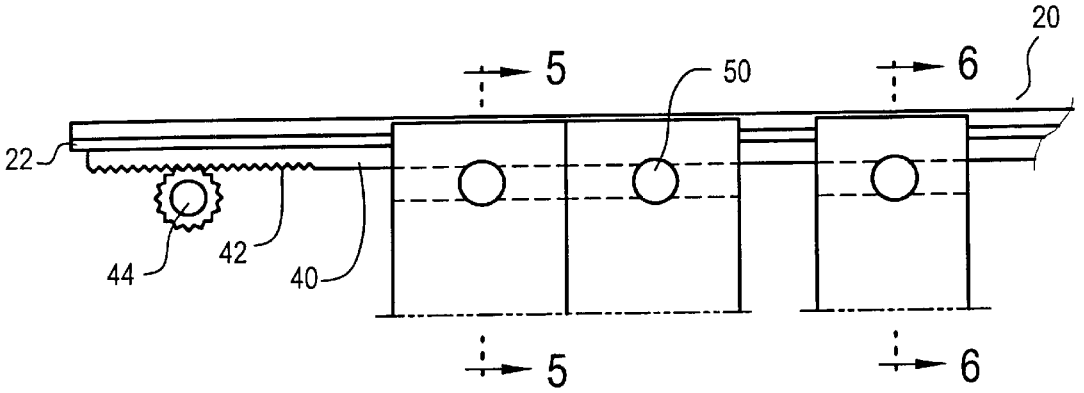
FIG. 4 shows a drive mechanism for jaw modules.

FIGS. 2 and 3 show schematically upper jaw 10 of the bending brake of FIG. 1 and the device that varies its width. Jaw 10 has several jaw modules 18, 19, all of similar These modules are guided on the two parallel rails 22. Between these two rails 22 is a space forming a groove in which a drive bar 40 is guided. This drive bar 40 is provided with a rack 42 at one of its ends, with which a gear 44 driven rotationally by a motor (not shown) meshes.

Each jaw module 18, 19 is provided with a device that either joins it to rails 22 or joins it to drive bar 40. When drive bar 40 moves, it brings with it the jaw modules 18, 19 attached to it, the others remaining stationery. Thus, it is possible to move each jaw module individually, or in a group of jaw modules, or any other conceivable combination.

Figure 5:
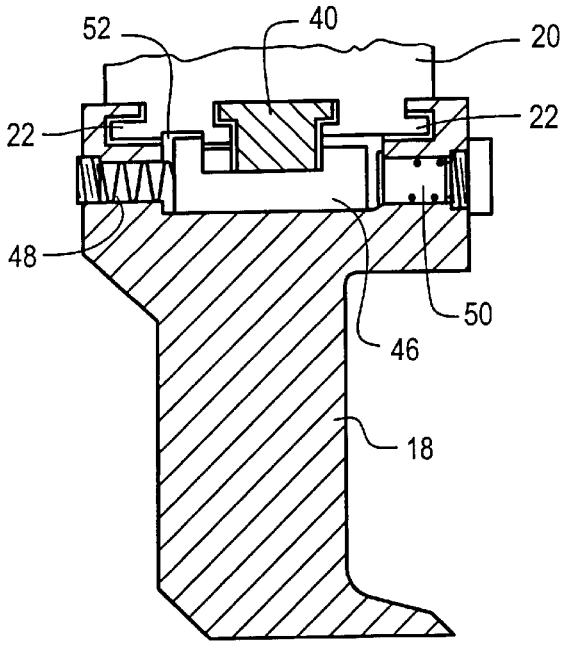
FIG. 5 is a cross section on an enlarged scale along line 5—5 in FIG. 4.
Figure 6:
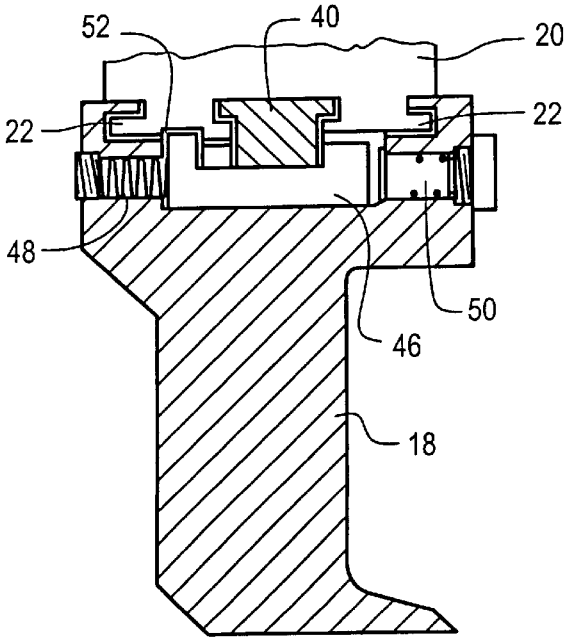
FIG. 6 is a cross section on an enlarged scale along line 6—6 in FIG. 4, FIGS. 7 to 10 represent several possible configurations of a device according to the invention.

FIGS. 5 and 6 show a cross section of a jaw module 18 and its associated locking device. The latter comprises in particular a locking part 46, a spring 48, and a pneumatic actuator 50.

Locking part 46 is placed in a recess provided in the side of the jaw module that faces rails 22. This recess is such that the locking part can move perpendicularly to rails 22. In a sectional plane perpendicular to rails 22 (FIGS. 5 and 6), locking part 46 has a generally U-shaped cross section. The arms of the U point to rails 22. The end of a first arm fits into a groove 52 provided longitudinally in a rail 22. The second arm faces the other guide rail 22. Drive bar 40 projects from the two rails 22 and is located between the two arms of locking part 46. The second arm of this part 46 faces drive bar 40.

At its first arm, the locking part is subjected to the action of spring 48, which urges the first arm of the locking part toward drive bar 40. At the second arm is pneumatic actuator 50. The latter can urge locking part 46 against spring 48 and thus push the second arm in the direction of drive bar 40.

FIG. 5 shows the position of jaw module 18 when actuator 50 is not acting. Spring 48 then urges locking part 46 toward drive bar 40. The first arm of this locking part 46 then abuts the wall of groove 52 provided in a rail 22. By reaction, jaw module 18 moves in the opposite direction, namely leftward in FIG. 5. Module 18 then abuts the outer face of rail 22 opposite spring 48. Thus, the jaw module is locked onto the two rails 22 and is thus coupled to frame 20.

FIG. 6 shows the position of jaw module 18 when actuator 50 acts. Actuator 50 then pushes locking part 46 so that its second arm abuts drive bar 40. By reaction, jaw module 18 moves in the direction opposite to the direction of movement of locking part 46, namely rightward in FIG. 6. The dimensions of the various guide grooves guiding jaw module 18 on rails 22 are such that jaw module 18 then abuts drive bar 40, not rail 22 opposite pneumatic actuator 50. Thus, jaw module 18 is coupled to drive bar 40.

Figure 7:
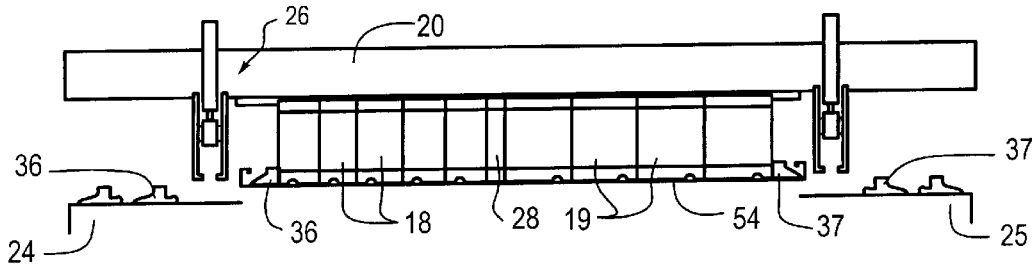

FIGS. 7 to 10 show several possible jaw configurations, among numerous others, obtained by associating jaw modules 18, 19 with end modules 36, 37. FIG. 7 shows a configuration in which all the jaw modules 18, 19 are grouped around central module 28 and an end module 36, 37 is located at each end.

Figure 8:
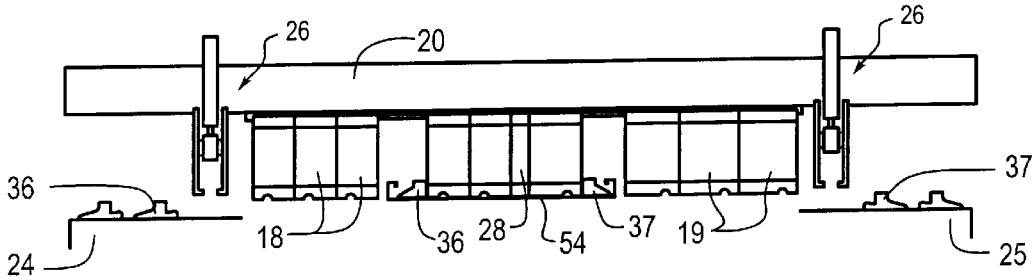

FIG. 8 shows another configuration. When changing from the configuration of FIG. 7 to that of FIG. 8, several steps are necessary, but they can be effected very rapidly. End modules 36, 37 are first replaced in their respective magazines. The three leftmost jaw modules 18 in FIGS. 7 and 8 are coupled to drive bar 40. The latter is moved leftward. The pressure in actuators 50 corresponding to these three jaw modules 18 is released. These modules thus become coupled to rails 22 and are fixed relative to frame 20. The three rightmost jaw modules 19 in FIG. 7 are then coupled to drive bar 40, subjecting the corresponding actuators 50 to pressure. All the other jaw modules 18, 19 remain coupled to rails 22 and are fixed relative to frame 20. Drive bar 40 moves rightward, bringing with it the three jaw modules 19.

While these movements of jaw modules 18, 19 are taking place, grippers 26 grip each end module 36, 37 in a corresponding magazine 24, 25 and position it on module 18, 19 forming the end of the jaw.

Figure 9:
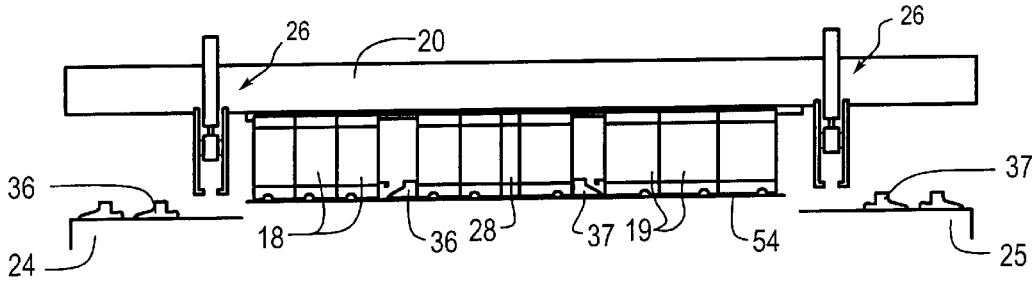

If, in the bending operation to be carried out by the bending brake, it is not necessary to have an end module at the end of the jaw, end modules 36, 37 can remain in place and be between two jaw modules 18, 19, as shown in FIG. 9. The time necessary for changing the configuration can then be slightly reduced.

Figure 10:
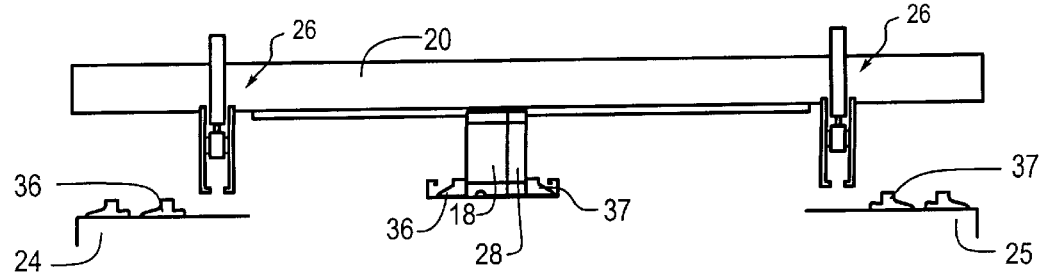

FIG. 10 shows a configuration in which an end module 37 is placed directly on central module 28. Thus, it is possible to have a narrow jaw.

By judiciously choosing the widths of jaw modules 18, 10 and end modules 36, 37, it is possible to cover an entire range of widths for the jaw obtained with a predetermined incrementation. The dimensional example, indicated below, enables all widths multiples of 5 mm to be obtained, starting at the width of 310 mm.

Thus, for example, one can choose jaw modules 18 with a width of 100 mm, which in the example shown in the drawing are at the left of central module 28, jaw modules 19 with a width of 150 mm, which will be to the right of central module 28, four end modules 36 associated with magazine 24 and hence destined to be mounted on jaw modules 18 with dimensions 80 mm, 90 mm, 100 mm, and 105 mm, and four end modules 37 associated with magazine 25 and hence destined to be mounted on jaw modules 19, measuring 80 mm, 85 m, 95 mm, and 105 mm. If, as shown in FIGS. 7 to 10, the jaw has five 100 mm jaw modules 18 and four 150 mm jaw modules 19, it is possible to assemble the various modules 28, 18, 19, 36, 37 to obtain any jaw width that is a multiple of 5 mm and is between 310 mm and 1310 mm.

Of course, the movement of grippers 26 and drive bar 40 can be controlled by a computer (not shown) which, depending on the necessary jaw width and the type of bend to be created, calculates the configuration to be adapted and the paths of the various elements, then supplies this information to a central control system that controls the movement of these elements.

The design of the modular jaw as described above allows a very rapid transition from one configuration to the next, lasting about ten seconds. Thus, it becomes possible to change the configuration at the same time as changing the sheet metal or the position of this sheet. Contrary to machines known to date, which require about ten times the setup time, the jaw configuration can be changed without taking extra time.

Figure 11:
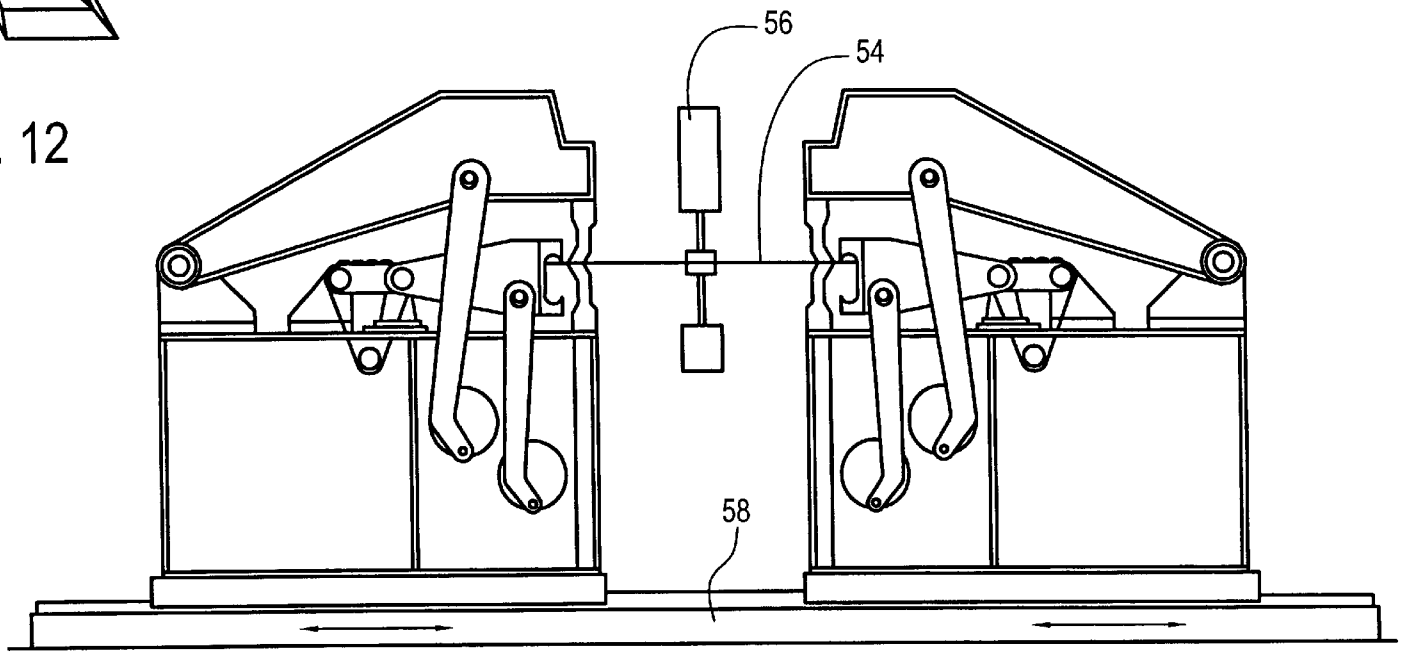
FIG. 11 shows in a side view two bending brakes opposite each other, each of them provided with a device according to the invention.
Figure 12:
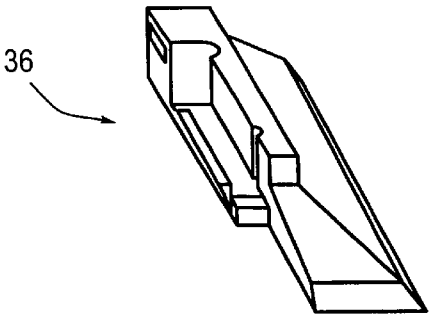
FIG. 12 is a perspective view of an end module.

It then becomes conceivable to place two bending brakes opposite one another, as shown in FIG. 11. A conveyor, not shown, brings a piece of sheet metal 54 to a position between the two bending brakes. A central rotator 56 is located between the two bending brakes to rotate a sheet of metal that is to be bent on four sides, or more. Of course, to adapt to the various dimensions of the sheet and the type of bend to be made, the two bending brakes must be able to move away from and toward each other. For this purpose, they are both mounted on a common base 58. A computer and a central control system can be provided to calculate and control the movements of the two machines on common base 58, but they can also control the modular jaws of the two machines.

It goes without saying that the invention is not confined to the embodiment described above as a nonlimiting example; on the contrary it covers all variants.

Thus, for example, each jaw module could be equipped with drive means enabling it to move by itself on the guide means. The drive bar would be replaced by a fixed rack extending over the entire length of the frame and each jaw module would be equipped with a motor with a gear at the end of its shaft. A brake would prevent the gear from turning, thus, locking the module onto the frame. The modules could be guided on guide columns.

The device enabling the size of a jaw to be adapted is not necessarily adapted to a bending brake a machine for bending around a specific radius. It can be mounted on any machine having a jaw such as a machine used to bend at an angle.

The size, shape, and number of the modules are provided only as examples to illustrate the invention. It is of course possible to multiply the number of modules to increase the number of possible configurations.

What is claimed is:

1. A device that adjusts a size of a jaw, the device comprising:

a frame provided with guides, jaw modules that move along the guides, means for independently locking each jaw module into a given position, a magazine of end modules located near each end of the guides, gripping and handling means for gripping an end module in the magazine to fit the end module on the jaw module and reposition the end module fitted on the jaw module to replace the end module in the magazine.

2. The device of claim 1, further comprising:

a central module mounted in a fixed position relative to the frame, wherein, the movable jaw modules are located on opposite first and second sides of the central module, the movable jaw modules on the first side of the central module all being similar and the jaw modules on the second side of the central module having a different length in a direction towards the guides than the movable jaw modules located on the first side of the central module.

3. The device of claim 1, wherein the guides are comprised of at least one rectilinear rail coupled to the frame.

4. The device of claim 3, further comprising:

two parallel rails on which the movable jaw modules are mounted;

a drive bar guided between the two parallel rails; and locking means that enable each movable jaw module independently of the other movable jaw modules, the locking means coupled to the drive bar or the guides.

5. The device of claim 4, wherein, each jaw module has a locking part that moves perpendicularly to the guides, the locking part having a U-shaped section, perpendicular to the guides, with an end of one arm of the U being in a lengthwise groove provided in one of the guides, an other arm end of the U being opposite one of the other guides, and the drive bar projecting between the two arms of the U, the device further comprising a spring and an actuator, the spring pretensions the locking part in one direction, making the locking part positioned next to the frame or the drive bar, the actuator acts against the spring to position the locking part next to the drive bar or the frame.

6. The device of claim 4 wherein, the drive bar includes a rack and the device further comprises a gear and a motor that drives the gear, the gear meshing with the rack of the drive bar.

7. The device of claim 1, wherein the gripping and handling means is comprised of a gripper moving lengthwise on the frame.

8. A machine that bends sheet metal, the machine comprising:

a plurality of jaws;

a bending tool; and a device that adjusts the size of the jaw according to claim 1.

9. The device of claim 2, wherein the guides are comprised of at least one rectilinear rail coupled to the frame.

10. The device of claim 9, further comprising:

two parallel rails on which the movable jaw modules are mounted;

a drive bar guided between the two parallel rails; and locking means that enable each movable jaw module independently of the other movable jaw modules, the locking means coupled to the drive bar or the guides.

11. The device of claim 10, wherein, each jaw module has a locking part that moves perpendicularly to the guides, the locking part having a U-shaped section, perpendicular to the guides, with an end of one arm of the U being in a lengthwise groove provided in one of the guides, an other arm end of the U being opposite one of the other guides, and the drive bar projecting between the two arms of the U, the device further comprising a spring and an actuator, the spring pretensions the locking part in one direction, making the locking part positioned next to the frame or the drive bar, the actuator acts against the spring to position the locking part next to the drive bar or the frame.

12. The device of claim 5 wherein, the drive bar includes a rack and the device further comprises a gear and a motor that drives the gear, the gear meshing with the rack of the drive bar.

13. The device of claim 10 wherein, the drive bar includes a rack and the device further comprises a gear and a motor that drives the gear, the gear meshing with the rack of the drive bar.

14. The device of claim 11 wherein, the drive bar includes a rack and the device further comprises a gear and a motor that drives the gear, the gear meshing with the rack of the drive bar.

15. The device of claim 2, wherein the gripping and handling means is comprised of a gripper moving lengthwise on the frame.

16. The device of claim 3, wherein the gripping and handling means is comprised of a gripper moving lengthwise on the frame.

17. The device of claim 4, wherein the gripping and handling means is comprised of a gripper moving lengthwise on the frame.

18. The device of claim 5, wherein the gripping and handling means is comprised of a gripper moving lengthwise on the frame.

19. A machining center, comprising:

a first machine that bends sheet metal, the first machine comprising:

a first plurality of jaws;

a first bending tool;

a first frame provided with first guides;

a first jaw modules that move along the first guides;

a first means for independently locking each first jaw module into a given position;

a first magazine of first end modules located near each end of the first guides; and a first gripping and handling means for gripping a first end module in the first magazine to fit the first end module on the first jaw module and reposition the first end module fitted on the first jaw module to replace the first end module in the first magazine;

a second machine that bends sheet metal, wherein the first and second machines are positioned opposite each other and movable toward or away from each other, the second machine, comprising:

a second plurality of jaws;

a second bending tool;

a second frame provided with second guides;

a second jaw modules that move along the second guides;

a second means for independently locking each second jaw module into a given position;

a second magazine of second end modules located near each end of the second guides; and a second gripping and handling means for gripping a second end module in the second magazine to fit the second end module on the second jaw module and reposition the second end module fitted on the second jaw module to replace the second end module in the second magazine; and a conveyor that conveys pieces of sheet metal, the conveyor located between the two machines.

20. The machining center of claim 19, wherein the jaws, hold the pieces of sheet metal and the machining center further comprises a central rotator that rotates the pieces of sheet metal to bend the pieces of sheet metal held by the jaws, the central rotator being located between the two machines.

* * * * *